US011649637B2

(12) United States Patent
Behrbohm

(10) Patent No.: US 11,649,637 B2
(45) Date of Patent: May 16, 2023

(54) HANDRAIL FOR SCAFFOLDING STRUCTURES

(71) Applicant: WILHELM LAYHER VERWALTUNGS-GMBH, Güglingen-Eibensbach (DE)

(72) Inventor: Wolf C. Behrbohm, Bietigheim-Bissingen (DE)

(73) Assignee: WILHELM LAYHER VERWALTUNGS-GMBH, Güglingen-Eibensbach (DE)

( * ) Notice: Subject to any disclaimer, the term of this patent is extended or adjusted under 35 U.S.C. 154(b) by 542 days.

(21) Appl. No.: 16/463,875

(22) PCT Filed: Nov. 24, 2017

(86) PCT No.: PCT/EP2017/080352
§ 371 (c)(1),
(2) Date: May 24, 2019

(87) PCT Pub. No.: WO2018/099817
PCT Pub. Date: Jun. 7, 2018

(65) Prior Publication Data

US 2019/0292790 A1 Sep. 26, 2019

(30) Foreign Application Priority Data

Dec. 1, 2016 (DE) ..... 10 2016 123 232.7

(51) Int. Cl.
*E04F 11/18* (2006.01)
*E04G 5/14* (2006.01)
*E04G 27/00* (2006.01)

(52) U.S. Cl.
CPC ..... *E04F 11/184* (2013.01); *E04G 5/14* (2013.01); *E04G 27/00* (2013.01)

(58) Field of Classification Search
CPC ..... E04G 21/32; E04G 21/3204; E04G 27/00; E04F 11/1836; E04F 11/184;
(Continued)

(56) References Cited

U.S. PATENT DOCUMENTS 2,767,959 A * 10/1956 Schott ..... E04F 11/184 D25/164
2,869,829 A * 1/1959 Spangberg ..... E04F 11/184 D25/63
(Continued)

FOREIGN PATENT DOCUMENTS

DE 19525334 7/1996
DE 29913389 11/1999
(Continued)

OTHER PUBLICATIONS

Australian Office action filed in App No. 2017369424 dated Apr. 27, 2020.
(Continued)

*Primary Examiner* — Brian D Mattei
*Assistant Examiner* — Kathleen M. McFarland
(74) *Attorney, Agent, or Firm* — Rankin, Hill & Clark LLP

(57) ABSTRACT

A handrail, in particular for scaffolding structures, for example stairway scaffolding structures, includes at least two handrail segments connected to one another by a connection unit to provide a continuous handrail, wherein at least one handrail securing element for securing the handrail segment to a scaffolding element is secured to at least one of the handrail segments, wherein the connection unit includes two connection elements that can pivot relative to one another about a pivot axis, wherein at least one connection element is/can be connected to one of the handrail segments connected to one another via the connection unit such that it
(Continued)

can rotate about an axis of rotation that is not parallel and not orthogonal in relation to the pivot axis.

12 Claims, 4 Drawing Sheets

(58) Field of Classification Search
CPC ..... E04F 11/1808; E04F 11/1834; E04H 17/1448; F16B 7/04; F16B 7/0446; F16B 7/044; F16C 11/10
See application file for complete search history.

(56) References Cited

U.S. PATENT DOCUMENTS 3,584,793 A * 6/1971 Ilzig ..... F16M 11/2021 362/427
3,733,055 A * 5/1973 Hughes, Jr. ..... E04F 11/184 256/65.03
3,752,262 A * 8/1973 Helms ..... E04G 5/14 182/178.1
4,132,391 A * 1/1979 Takenaga ..... B63B 17/04 256/65.1
4,193,585 A * 3/1980 Eandi ..... E04F 11/184 182/106
4,286,353 A * 9/1981 Roche ..... F16C 11/10 403/81
4,522,270 A * 6/1985 Kishi ..... B23B 45/001 74/543
4,602,766 A * 7/1986 Naka ..... E04F 11/184 D25/43
4,748,671 A * 5/1988 Wiegel ..... H04M 1/05 16/337
4,767,232 A * 8/1988 Francis ..... E04F 11/1834 403/113
4,912,349 A * 3/1990 Chang ..... B25F 5/02 173/217
5,541,822 A * 7/1996 Bamber ..... F21V 21/406 362/202
5,657,968 A * 8/1997 Marsden ..... E04F 11/1863 256/65.16
5,661,942 A * 9/1997 Palmer ..... E04H 15/48 135/156
5,689,999 A * 11/1997 Wiley ..... F16C 11/10 403/107
6,161,948 A * 12/2000 Hagen ..... F21V 31/00 362/267
6,220,577 B1 * 4/2001 Ostrow ..... E04G 21/3223 256/DIG. 1
6,257,799 B1 * 7/2001 Ribe ..... E04F 11/1834 403/402
6,984,054 B2 * 1/2006 Lai ..... F21L 14/026 362/199
7,631,575 B2 * 12/2009 Gard ..... F16C 11/10 74/530
7,971,840 B2 * 7/2011 Hirschhorn ..... F16M 11/2064 248/278.1
10,030,423 B2 * 7/2018 Eaton ..... H04R 1/08
10,323,422 B1 * 6/2019 Eddy ..... E04G 7/00
10,569,717 B2 * 2/2020 Peters ..... F16M 11/08
11,007,944 B1 * 5/2021 Hanser ..... E04G 5/14
11,046,226 B1 * 6/2021 Younce ..... B60N 3/023
2002/0110406 A1 * 8/2002 Coles ..... F16B 7/185 403/57
2004/0179891 A1 * 9/2004 Watkins ..... F16C 11/10 403/96
2012/0326108 A1 * 12/2012 Eves ..... E04F 11/1836 256/60
2014/0191177 A1 * 7/2014 Bailie ..... E04F 11/1834 256/67
2014/0318891 A1 * 10/2014 Crothers ..... E04F 11/1861 182/113
2015/0252569 A1 * 9/2015 Warshaw ..... E04F 11/1834 403/205
2018/0106085 A1 * 4/2018 Lapchev ..... E05D 11/10
2019/0292790 A1 * 9/2019 Behrbohm ..... E04G 5/14
2019/0376343 A1 * 12/2019 Maxfield ..... E06C 7/48
2021/0002904 A1 * 1/2021 Mornan ..... E04F 11/1865
2021/0010273 A1 * 1/2021 Winter ..... E04F 11/1836
2021/0293028 A1 * 9/2021 Owen ..... F16B 7/187

FOREIGN PATENT DOCUMENTS

| | | |
|---|---|---|
| EP | 0688920 | 12/1995 |
| EP | 0884433 | 12/1998 |
| FR | 2914671 | 10/2008 |
| FR | 2983503 | 6/2013 |
| JP | 2011-241560 | 1/2011 |
| WO | 2016/054676 | 4/2016 |

OTHER PUBLICATIONS

International Search Report filed in PCT/EP2017/080352 dated Dec. 1, 2018.

* cited by examiner

HANDRAIL FOR SCAFFOLDING STRUCTURES

The present invention relates to a handrail, which can be attached to scaffolding elements of scaffolding structures to increase the security of scaffolding structures, such as stairway scaffolding structures.

In scaffolding structures, especially stairway scaffolding structures, due to legal requirements there may be a need, for example, to provide handrails on stair railings or other scaffolding elements. Since there is a high variability in the construction design of such scaffolding structures, it is necessary to be able to make the handrails to be provided on the scaffolding structures accordingly variable and easy to mount.

The subsequently published German patent application DE 10 2015 109 767 discloses a handrail attachable to a scaffold structure. Successive handrail segments in the longitudinal direction of the handrail are connected to one another by connection units which comprise two connection elements which in each case are/can be connected to one of the two handrail segments and can pivot relative to one another about a pivot axis that is orthogonal to the longitudinal direction of the handrail segments to be connected to one another.

It is the object of the present invention to provide a handrail, in particular for scaffolding structures, as well as a method for mounting such handrail, which allow easy mounting with high variability in construction.

According to a first aspect, this object is achieved by a handrail, in particular for scaffolding structures, for example stairway scaffolding structures comprising at least two handrail segments, for example tubular handrail segments, connected to one another by a connection unit to provide a continuous handrail, wherein at least one handrail securing element for securing the handrail segment to a scaffolding element is secured to at least one of the handrail segments, wherein the connection unit comprises two connection elements that can pivot relative to one another about a pivot axis, wherein at least one, preferably every connection element is/can be connected to one of the handrail segments connected to one another via the connection unit such that it can rotate about an axis of rotation that is not parallel and not orthogonal in relation to the pivot axis.

By the inventive pivotability of the two connection elements of a connection unit relative to one another and the rotatability with respect to at least one of the handrail segments, it is possible to connect to one another the handrail segments to be connected to one another therewith in corner or bend sections of the handrail to provide a continuous handrail adapted to the structure of the scaffold structure.

For an easy to implement, yet stable construction, it is proposed that at least one, preferably every handrail securing element is preferably secured to a handrail segment by riveting or screwing.

To enable the connection of a handrail segment with a connection element, that can be rotated relative to one another, it can be provided that the at least one, preferably every connection element has a handrail segment receiving opening that is open at a first axial end section of the connection element in the direction of the axis of rotation for receiving a handrail segment that can be rotated about the axis of rotation. In an alternative embodiment it can be provided that at least one, preferably every connection element has a plug-in portion for receiving that can be rotated about the axis of rotation in a handrail segment which is particularly possible in a simple manner when the handrail segment is formed as a pipe providing an inner opening The adaptability of a connection unit to different angles between handrails segments to be positioned successively can be realized, for example, in that every connection element has, in a second axial end section of the connection element, an end face that is angled in relation to the axis of rotation, wherein the two connection elements face each other with their angled end faces and can pivot relative to one another about the pivot axis that is substantially orthogonal in relation to the two angled end faces.

In this case, a fixed bracket of the two connection elements nevertheless permitting the defined pivotability thereof to one another can be achieved in that the two connection elements are connected to one another such that they can rotate about the axis of rotations, by a connecting element that at least in relation to one of the connection elements can rotate about the pivot axis.

The connecting element in association with at least one of the connection elements can comprise a group of latching projections arranged in ring-like configuration about the pivot axis, wherein an opening receiving the group of latching projections is provided in the connection element such that the group of latching projections can rotate about the pivot axis.

The pivot axis is preferably arranged at an angle of 45° in relation to the axis of rotation.

According to a further aspect, the object specified at the outset is achieved by a method for mounting a handrail according to the invention on a scaffolding structure, in particular a stairway scaffolding structure, comprising the measures of a) securing at least one handrail securing element to a scaffolding element;
b) before or after measure a), attaching a handrail segment to at least one handrail securing element mounted or to be mounted to a scaffold element in measure a);
c) before or after measure b), attaching a connection element of a connection unit to at least one end section of the handrail segment attached or to be attached in measure b);
d) before or after measure c), attaching a further handrail segment to the other connection element of the connection unit;

and preferably:

e) attaching the further handrail segment to at least one handrail securing element secured to a scaffolding element.

With this procedure, a continuous handrail can be constructed successively and with high variability, for which purpose the measures indicated above can be performed repeatedly.

In order to obtain a stable construction, it is proposed that measure b) or/and e) comprises securing a handrail segment to at least one handrail securing element by riveting or screwing.

According to the invention, provision may further be made for measure b) to comprise the securing of the handrail segment before measure c) is performed. Alternatively, it is possible to first provisionally fix one or more of the handrail segments, for example by clamping elements, and then to firmly connect them to the associated handrail securing elements when the continuous handrail or at least a portion thereof is provided by repeated repetition of the above-indicated measures.

In order to enable the connection of the handrail segments to be connected to one another in the respectively provided mounting position for them, it is proposed that in measure c) or d) the one connection element of the connection unit is brought in such a rotational position in relation to the handrail segment attached to a scaffold element in measure b) or/and the two connection elements of the connection unit are brought into such a pivoting position relative to one another, that in measure e) the further handrail segment can be attached to at least one handrail securing element that is secured to a scaffold element.

The invention further relates to a scaffolding structure, in particular a stairway scaffolding structure, comprising a handrail according to the invention, preferably mounted with a method according to the invention.

The present invention will be described below in detail with reference to the accompanying drawings.

Figure 1:
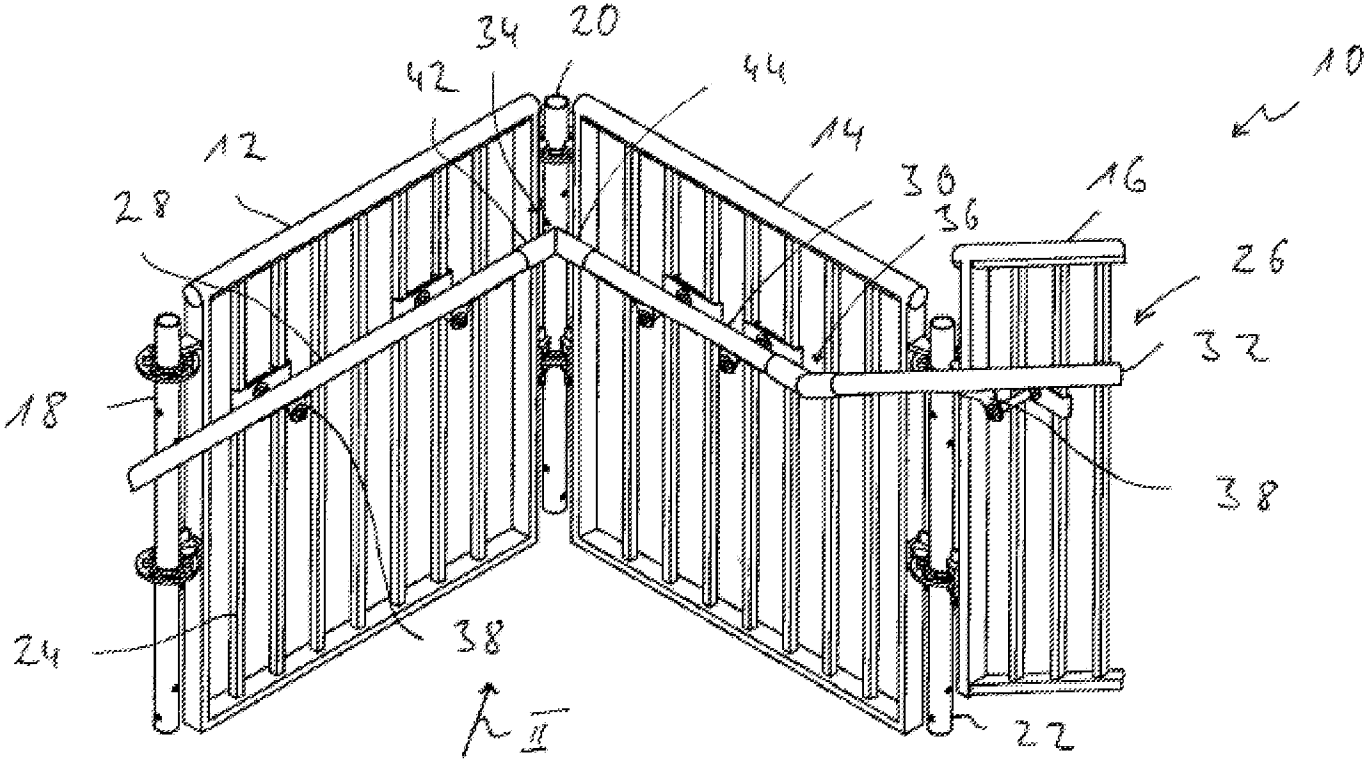
FIG. 1 shows a portion of a scaffolding structure with a handrail attached thereto, viewed obliquely from above in the direction of view I in FIG. 2.
Figure 2:
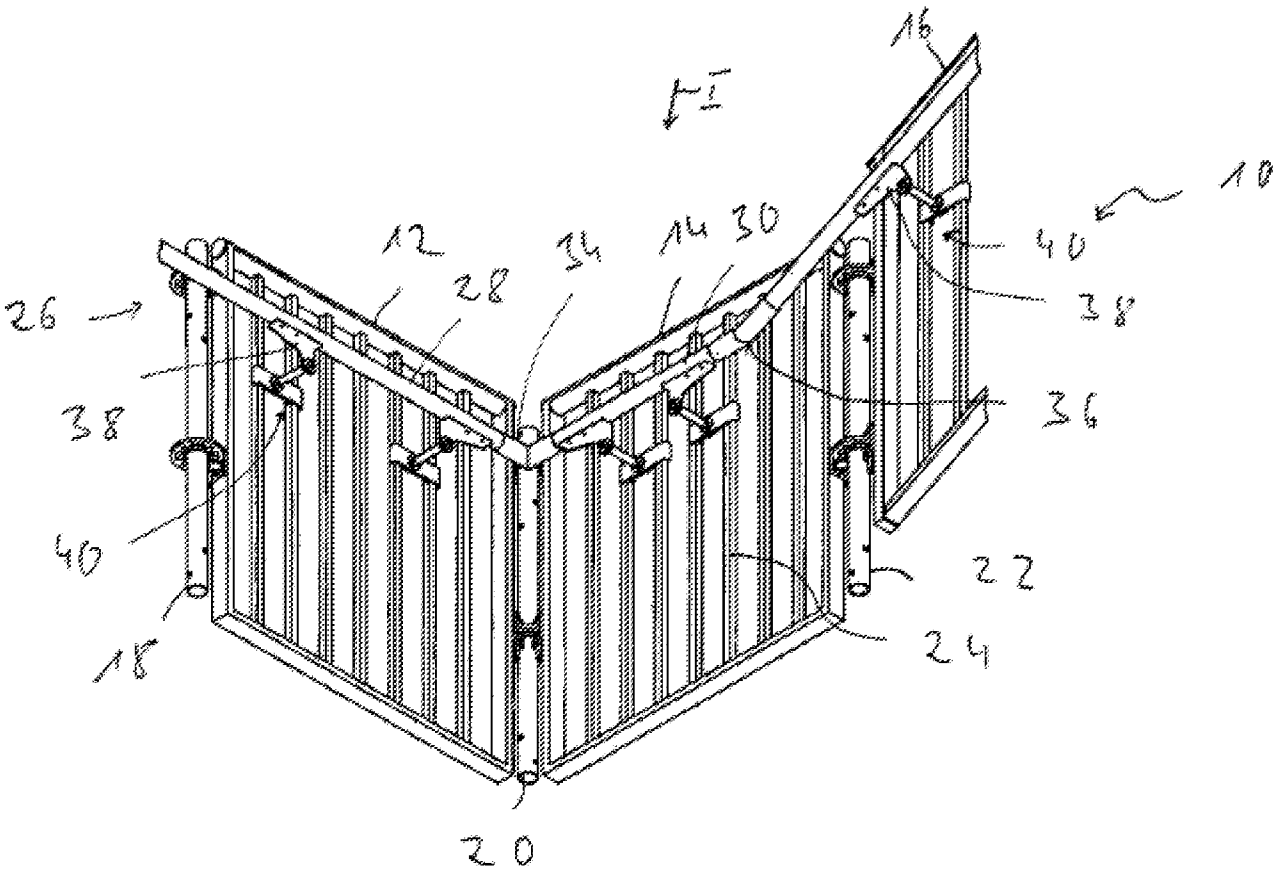
FIG. 2 shows the proportion of a scaffolding structure shown in FIG. 1, viewed obliquely from below in the direction of view II in FIG. 1

FIGS. 1 and 2 show a portion of a scaffolding structure 10, for example a stairway scaffolding tower, on which in association with stairway portions or landing sections banister elements 12, 14, 16 are attached to vertical stems 18, 20, 22, for example. Each of the banister elements 12, 14, 16 may have a plurality of rods 24 extending substantially vertical and parallel to one another.

A handrail 26 mounted on scaffolding 10 comprises a plurality of handrail segments 28, 30, 32. Handrail segments 28, 30, 32 are preferably tube-like constructed of metal material. In corner or bend sections adjoining handrail segments 28, 30, 32 are connected to one another by connection units 34, 36 which are preferably identical to one another to provide a substantially uninterruptible continuous handrail 26.

In the illustrated exemplary embodiment a plurality of handrail securing elements 38 are preferably fixed by riveting or screwing at each of handrail segments 28, 30, 32. Handrail securing elements 38 made of sheet metal material are bent, for example, into the desired shape and are releasably secured by screw clamping elements 40 to the rods 24 of the banister elements 12, 14, 16.

Figure 3:
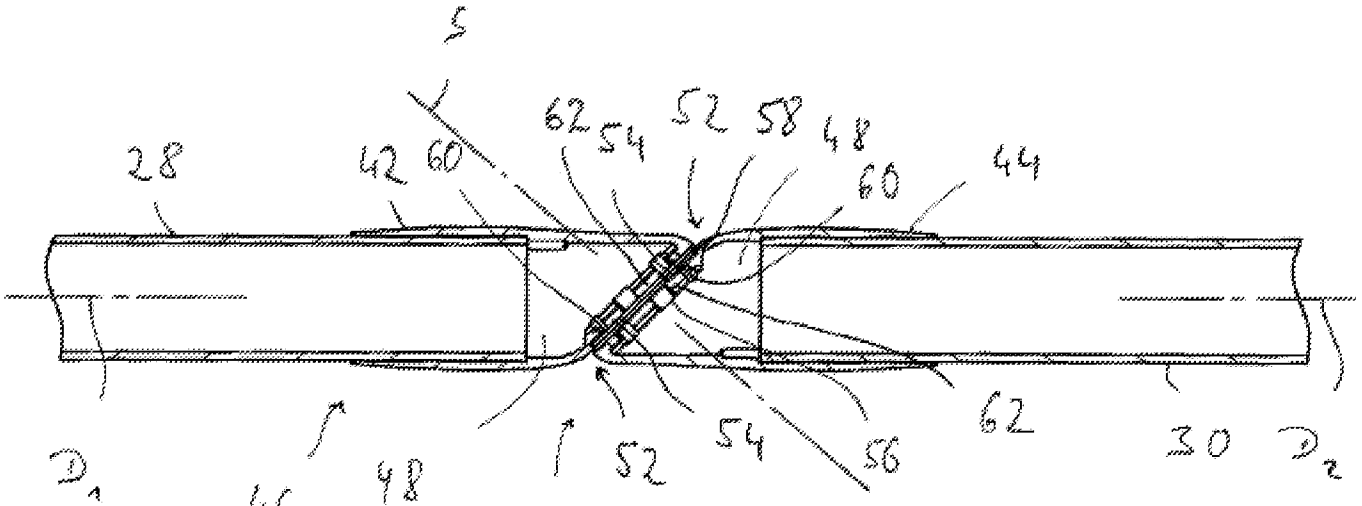
FIG. 3 shows a schematic diagram of a connection unit used in the handrail of FIGS. 1 and 2.

FIG. 3 shows a schematic representation of connection unit 34 interacting with the two handrail segments 28, 30. Connection unit 34 comprises two connection elements 42, 44 which are preferably identical to one another and are constructed, for example, from plastic material. Substantially hollow connection elements 42, 44 each have a handrail segment receiving opening 48 which is open at an axial end section 46. At their other axial end section 50, the connection elements 42, 44 each have an angled end face 52 having a respective end surface 54, preferably angled at an angle of 45° or a complementary angle of 135° with respect to a longitudinal extension direction of the handrail segment receiving openings 48 corresponding to a rotational axis $D_1$ or $D_2$.

The connection elements 42, 44 are connected to one another by a connection element 56 interacting with the two connection elements 42, 44 in the section of angled end faces 52 or end faces 54, and can pivot relative to one another about a pivot axis S which is substantially orthogonal to respective end faces 52 or their end surfaces 54. Pivot axis S intersects the axis of rotation $D_1$, $D_2$ and is inclined in relation to the two axes of rotation $D_1$, $D_2$ at an angle of 45° or a complementary angle of 135°.

In the exemplary embodiment illustrated, connecting element 56 comprises a ring-like or disc-like body 58, of which in each case in both axial directions in the direction of pivot axis S a group of engagement projections 60 projects in a ring-like configuration with circumferential spacing of the engagement projections 60 to one another. In association with each such group of engagement projections 60 arranged in a ring-like configuration, circle-like openings 62 are provided in the two end faces 52 of connection elements 42, 44, through which engagement projections 60 of a respective group extend and engage from behind the associated end face 52 at the rear side facing away from the respective end surface 54. Each of the two groups of engagement projections 60 can rotate about pivot axis S in associated opening 62, so that the two connection elements 42, 44 adjoining to one another via body 58 of the connecting element 56 can pivot relative to one another about pivot axis S and are held together by the connecting element 56.

Connecting element 56 may be constructed of plastic material, for example.

In an alternative embodiment, the connecting element may be integrated in one of the connection elements. On the end face of this connection element a group of engagement projections which are protruding from the end surface thereof in a ring-like configuration, may be provided. At the other connection element an opening is provided in association with these engagement projections, in which the engagement projections engage the end face of this other connection element from behind. In this embodiment, the connecting element is thus integrally formed with one of the connection elements.

Handrail segment receiving openings 48 provided in connection elements 42, 44 are adapted in their cross-sectional shape or dimensioning to the cross-sectional shape or dimensioning of the handrail segments 28, 30 to be accommodated therein, for example with circular geometry, so that handrail segments 28, 30 can be received in the handrail segment receiving openings 48 rotatably about the respective axis of rotation $D_1$, $D_2$. Thus, connection unit 34 can rotate in relation to each of handrail segments 28, 30 connected or to be connected thereto about a respective axis of rotation $D_1$, $D_2$ which is inclined with respect to a pivot axis S at an angle of 45°. In an alternative embodiment, the connection elements could each have a plug-in portion which can be plugged into an end section of the handrail segment to be connected to this connection element, so that it can be rotated in the handrail segment.

Figure 4:
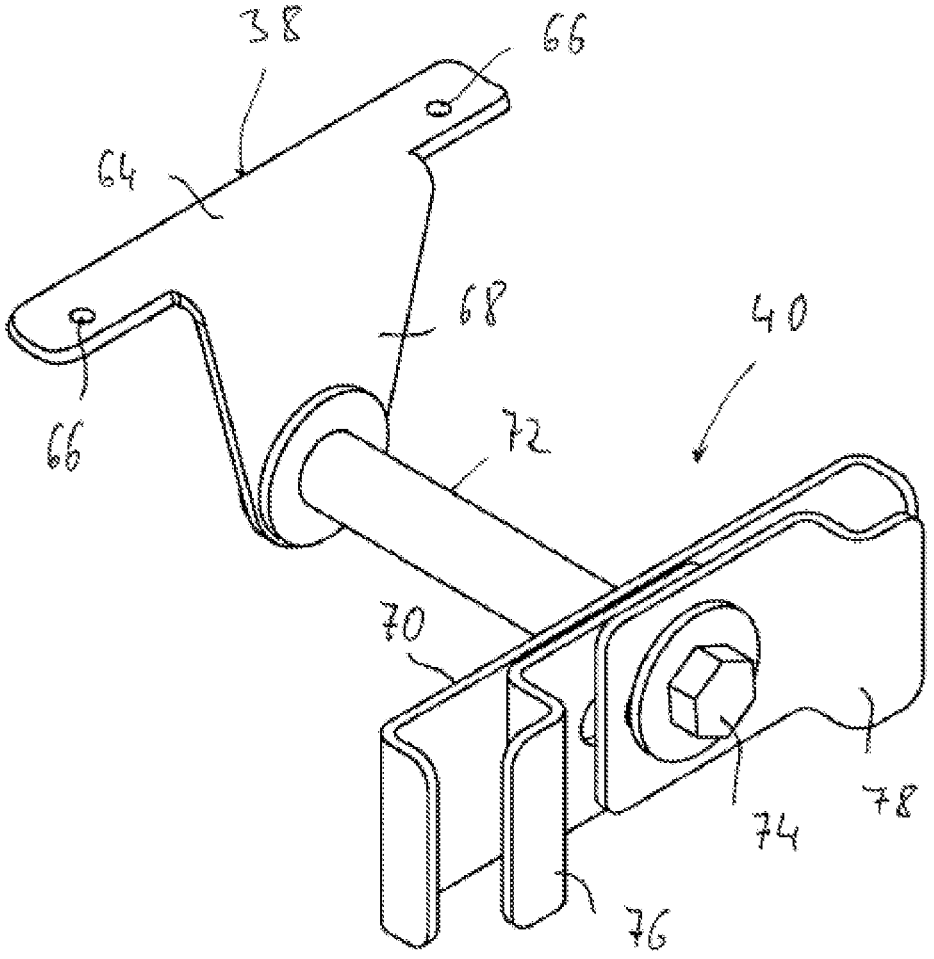
FIG. 4 shows a handrail securing element with a screwing clamping element

FIG. 4 shows a handrail securing element 38 and a screw clamping element 40 provided for attachment thereof to a banister element 12, 14, 16. The handrail securing element 38 which is bent for example of sheet metal, has a first securing portion 64 to be positioned fittingly to a handrail segment 28, 30, 32, with openings 66 formed therein, through which securing means, such as screw bolts or rivet bolts, can be passed to secure handrail securing element 38 to a handrail segment 28, 30, 32. A second securing section 68 extends at an angle to the first securing section 64 and is arranged so as to extend substantially downward in the constructed handrail 26 so that there is no obstruction on an upper side of the handrail.

The screw clamping element 40 comprises a substantially U-shaped first clamping plate 70 and two second clamping plates 76, 78 which in relation to the first clamping plate 70 can be braced by a screw bolt 74 which can be screwed into a connection bridge 72. The two second clamping plates 76, 78 can be displaced along the first clamping plate 70 and can thus be brought into a position in which in each case a rod 24 of a banister element 12, 14, 16 is positioned between the U-shaped first clamping plate 70 and one of the approximately Z-shaped second clamping plates 76, 78. Subsequently, the two second clamping plates 76, 78 are displaced away from one another along first clamping plate 70, so that they each engage a rod 24 from behind. Subsequently, screw bolt 74 can be tightened, so that a rod 24 is held in a clamped manner between each second clamping plate 76, 78 and first clamping plate 70. In the end section of connection bridge 72 facing away from the securing of clamping plates 70, 76, 78 by means of screw bolt 74, the second securing section 68 of a handrail securing element 38 can be secured before or after the attachment of screw clamping element 40 to a banister element 12, 14, 16, for example, also by a screw bolt which is not visible in FIG. 4, at connection bridge 72. In this way, the angular position between the handrail securing element 38 and the screw clamping element 40 can be adjusted freely in adaptation to a respective slope of handrail 26.

When mounting a handrail 26 constructed with such connection units 34, 36 to a scaffolding structure 10, it is possible to proceed, for example, by securing first, in association with at least handrail segment 28, handrail securing elements 38 provided for this handrail segment 28 by means of the screw clamping elements 40 interacting therewith to banister element 12 in the height positioning provided for this purpose and with the horizontal distance provided therefore.

Subsequently, handrail segment 28 can be attached to securing elements 38. For this purpose, for example, a provisional fixing by clamping elements can be carried out. Alternatively, handrail segment 28 can preferably be secured by screwing or riveting to securing elements 38 associated therewith, for which purpose, for example, the holes required for receiving the securing means are still to be introduced into handrail segment 28.

Before or after the provisional or final securing of handrail segment 28 on securing elements 38 associated therewith and already carried on banister element 12, connection unit 34 is pushed on handrail segment 28 with its connection element 42. In this state, the other connection element 44 of connection unit 34 may already be pushed onto one end of handrail segment 30. By pivoting the two connection elements 42, 44 relative to one another and by rotating connection unit 34 or connection element 42 in relation to handrail segment 28 about axis of rotation $D_1$, connection unit 34 can be brought into such a position that handrail segment 30 already provided thereon is substantially positioned so that it rests on securing elements 38 associated therewith and previously secured to railing element 14, or that, if handrail 30 has not previously been pushed into connection element 44, this connection element 44 is positioned substantially so that handrail segment 30 can be pushed into the same and, optionally, after a further rotation of connection element 42 about the axis of rotation $D_1$ or/and a further pivoting of the two connection elements 42, 44 relative to one another about pivot axis S, handrail 30 rests on securing elements 30 associated therewith and already secured to banister element 14. Subsequently, handrail segment 30 can be provisionally secured to securing elements 38 associated therewith or can be secured thereto by screwing or riveting, for example.

In a next mounting step, connection unit 36 can then be pushed onto the other end of handrail segment 30, wherein, in this state, connection unit 36 can already be connected to handrail segment 32. The procedure described above is then repeated for handrail segment 32 for attaching it to the securing elements 38 associated therewith and previously secured to banister element 16.

It should be noted that a plurality of handrail segments connected with one another in each case by connection units may be provided for providing a longer portion of the handrail and may be attached to securing elements associated therewith and already secured to banister elements or other scaffolding elements. In this case, the various connection units are brought into a configuration adapted to corner and bent sections of the handrail to be built by pivoting the connection elements of the same relative to one another and rotating the connection elements in relation to the handrail segments interacting with the same.

In the above-described mounting of the handrail, it is advantageous if for several, for example, all handrail segments the securing elements associated therewith are secured to the respectively intended position on the scaffolding structure before subsequently the handrail segments and the connection units interacting therewith are mounted successively, for example, starting from a lower end of a scaffolding structure. For this purpose, the handrail segments are preferably provided as portions already preconfigured with suitable length. If necessary, the handrail segments can also be cut to the appropriate length when they are mounted.

In principle, it is possible, to firmly connect one or more of the handrail segments already with the securing elements associated therewith, e.g., by riveting, and subsequently attach these securing elements to the screw clamping elements already secured to the scaffolding structure, or secure the screw clamping elements already attached thereto to the scaffolding structure.

Once a scaffolding structure has been completely equipped with a handrail, this handrail can be reused after dismantling and rebuilding the scaffolding structure. In this case the handrail segments of this handrail are already firmly connected to the securing elements associated therewith. When remounting the handrail, the connection units, which are basically not firmly connected to the or at least a part of the handrail segment(s) interacting therewith, can be brought in the appropriate position in the respective corner or bent sections of the handrail by pivoting and rotating to ensure that the securing elements already secured to the handrail segments in the handrail come to lie substantially at the bottom of the handrail segments. Again, the screw clamping elements interacting with the securing elements can be secured previously to the scaffolding structure, or can first be attached to the securing elements and then secured to the scaffolding structure together with these.

The invention claimed is:

1. A handrail for scaffolding structures comprising:

two handrail segments connected to one another by a connection unit to provide a continuous handrail, wherein at least one handrail securing element is secured to at least one of the two handrail segments for securing the handrail segment to a scaffold element, wherein the connection unit comprises two connection elements axially connected to one another other the direction of a pivot axis such as to be pivotally about the pivot axis relative to one another by a connecting element, wherein a first one of the two connection elements is connected to a first one of the two handrail segments, and a second one of the two connection elements is connected to a second one of the two handrail segments, wherein at least one of the first one of the two connection elements is connected to the first one of the two handrail segments rotatably relative to the first one of the two handrail segments about a first axis of rotation that is not parallel and not orthogonal in relation to the pivot axis, and the second one of two connection elements is connected to the second one of the two handrail segments rotatably relative to the second one of the two handrail segments about a second axis of rotation that is not parallel and not orthogonal in relation to the pivot axis, wherein the first one of the two connection elements has a first axial end section and a second axial end section, and the second one of the two connection elements has a first axial end section and a second axial end section, wherein the first one of the two connection elements has in the second axial end section thereof an end face that is angled in relation to the first axis of rotation and that is substantially orthogonal in relation to the pivot axis, and the second one of the two connection elements has in the second axial end section thereof an end face facing the end face of the first one of the two connection elements, the end face of the second one of the two connection elements being angled in relation to the second axis of rotation and being substantially orthogonal in relation to the pivot axis, wherein at least one of:

a first opening being provided in the end face of the first one of the two connection elements concentrically to said pivot axis, the connecting element in association with the first one of the connection elements comprising a first group of latching projections arranged in ring-like configuration about the pivot axis, all the latching projections of the first group of latching projections extending through the first opening and engaging the end face of the first one of the two connection elements from behind, the first group of latching projections being received in the first opening rotatably about the pivot axis, and a second opening being provided in the end face of the second one of the two connection elements concentrically to said pivot axis, the connecting element in association with the second opening provided in the end face of the second one of the connection elements comprising a second group of latching projections arranged in ring-like configuration about the pivot axis, all the latching projections of the second group of latching projections extending through the second opening and engaging the end face of the second one of the two connection elements from behind, the second group of latching projections being received in the second opening rotatably about the pivot axis.

2. The handrail according to claim 1, wherein at least one handrail securing element is secured to one of the two handrail segments by riveting or screwing.

3. The handrail according to claim 1, wherein at least one of the first one of the two connection elements includes a handrail segment receiving opening that is open at the first axial end section of the first one of the two connection elements in the direction of the first axis of rotation for rotatably receiving the first one of the two handrail segments, and the second one of the two connection elements includes a handrail segment receiving opening that is open at the first axial end section of the second one of the two connection elements in the direction of the second axis of rotation for rotatably receiving the second one of the two handrail segments.

4. The handrail according to claim 1, wherein the connecting element is rotatable about the pivot axis relative to each one of the two connection elements.

5. The handrail according to claim 4, wherein the connecting element in association with the first one of the two connection elements comprises the first group of latching projections arranged in ring-like configuration about the pivot axis and extending through the first opening and engaging the end face of the first one of the two connection elements from behind, and in association with the second one of the two connection elements comprises the second group of latching projections arranged in ring-like configuration about the pivot axis and extending through the second opening and engaging the end face of the second one of the two connection elements from behind.

6. The handrail according to claim 1, wherein the pivot axis is arranged at an angle of 45° in relation to the first axis of rotation and in relation to the second axis of rotation.

7. A method for mounting the handrail of claim 1 on a scaffolding structure comprising:

a) securing the at least one handrail securing element to a scaffolding element;

b) before or after step a), attaching at least one of the handrail segments to the at least one handrail securing element mounted or to be mounted to the scaffold element in step a);

c) before or after step b), attaching the at least one connection element of the connection unit to at least one end section of the handrail segment attached or to be attached in step b);

d) before or after step c), attaching a further handrail segment to the other connection element of the connection unit;

and e) attaching a further handrail segment to at least one handrail securing element secured to a scaffolding element.

8. The method according to claim 7, wherein step b) or/and step e) comprises securing the at least one handrail segment to the at least one handrail securing element by riveting.

9. The method according to claim 8, wherein step b) comprises securing the at least one handrail segment before performing step c).

10. The method according to claim 7, wherein in step c) or in step d) the one connection element of the connection unit is brought in such a rotational position in relation to the handrail segment attached to the scaffold element in step b) and/or the two connection elements of the connection unit are brought into such a pivoting position relative to one another, that in step e) the further handrail segment can be attached to at least one handrail securing element that is secured to a scaffold element.

11. A scaffolding structure, comprising a handrail according to claim 1, mounted with a method according to claim 7.

12. The handrail according to claim 5, wherein the connecting element comprises a ring-like or disc-like body, the latching projections of the first group of latching projections projecting from the body in a ring-like configuration with mutual circumferential spacing in a first axial direction, and the latching projections of the second group of latching projections projecting from the body in a ring-like configuration with mutual circumferential spacing in a second axial direction opposite to the first axial direction.

* * * * *